US009016852B2

(12) United States Patent
Takemura et al.

(10) Patent No.: US 9,016,852 B2
(45) Date of Patent: Apr. 28, 2015

(54) IMAGE FORMING APPARATUS

(71) Applicant: Canon Kabushiki Kaisha, Tokyo (JP)

(72) Inventors: Makoto Takemura, Tokyo (JP); Masaya Shimmachi, Kawasaki (JP); Yasuhito Tsubakimoto, Tokyo (JP); Kaneto Tokuyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/273,791
(22) Filed: May 9, 2014

(65) Prior Publication Data

US 2014/0246825 A1 Sep. 4, 2014

Related U.S. Application Data

(62) Division of application No. 13/548,707, filed on Jul. 13, 2012, now Pat. No. 8,757,794.

(30) Foreign Application Priority Data

Aug. 19, 2011 (JP) ..... 2011-179611

(51) Int. Cl.

| | |
|---|---|
| ***B41J 29/13*** | (2006.01) |
| ***B41J 29/02*** | (2006.01) |
| ***B65H 1/28*** | (2006.01) |
| ***B65H 29/52*** | (2006.01) |
| ***B65H 31/02*** | (2006.01) |
| ***B65H 31/20*** | (2006.01) |
| ***B65H 1/04*** | (2006.01) |

(52) U.S. Cl.

CPC . *B65H 1/28* (2013.01); *B41J 29/13* (2013.01); *B65H 29/52* (2013.01); *B65H 31/02* (2013.01); *B65H 31/20* (2013.01); *B65H 1/04* (2013.01); *B65H 2301/3122* (2013.01); *B65H 2301/4212* (2013.01); *B65H 2402/441* (2013.01); *B65H 2402/46* (2013.01); *B65H 2404/743* (2013.01); *B65H 2405/11164* (2013.01); *B65H 2405/1117* (2013.01); *B65H 2405/3322* (2013.01); *B65H 2601/321* (2013.01); *B65H 2701/1311* (2013.01); *B65H 2405/324* (2013.01)

(58) Field of Classification Search

CPC ..... B41J 13/103; B41J 29/13; B41J 15/044; B65H 2405/1117; B65H 2601/321; B65H 2405/31

USPC ..... 347/104, 108, 109; 271/9.11; 400/693, 400/718

See application file for complete search history.

(56) References Cited

U.S. PATENT DOCUMENTS

| | | | | |
|---|---|---|---|---|
| 6,665,047 | B1 | 12/2003 | Kimura et al. | |
| 6,830,401 | B1 * | 12/2004 | Hwang et al. | 400/693 |
| 6,848,685 | B2 | 2/2005 | Katsuyama | |
| 8,202,015 | B2 * | 6/2012 | Peck et al. | 400/693 |
| 8,757,794 | B2 * | 6/2014 | Takemura et al. | 347/108 |

FOREIGN PATENT DOCUMENTS

| | | | |
|---|---|---|---|
| JP | 01-321239 | A | 12/1989 |
| JP | 09-090523 | A | 4/1997 |
| JP | 2001-097611 | A | 4/2001 |
| JP | 2003-089249 | A | 3/2003 |
| JP | 2005-088219 | A | 4/2005 |
| JP | 2005-119096 | A | 5/2005 |

OTHER PUBLICATIONS

Office Action in Japanese Patent Application No. 2011-179611, dated Feb. 10, 2015.

* cited by examiner

*Primary Examiner* — An Do

(74) *Attorney, Agent, or Firm* — Fitzpatrick, Cella, Harper & Scinto

(57) ABSTRACT

An image forming apparatus includes a housing having an access cover, a paper feed tray, and a paper discharge tray provided on a side thereof in a rotatable manner. A rotation pivot of the paper feed tray and a rotation pivot of the access cover are arranged on the same axis, and a rotation pivot of the paper discharge tray is arranged with a shift from the rotation pivot of the access cover.

9 Claims, 6 Drawing Sheets

IMAGE FORMING APPARATUS

This application is a divisional of U.S. patent application Ser. No. 13/548,707, filed Jul. 13, 2012.

BACKGROUND OF THE INVENTION

1. Field of the Invention

The present invention relates to an image forming apparatus, and more particularly, to a configuration of a discharge sheet tray for supporting a printed sheet, which is capable of maintaining positional relationships with a feed sheet tray, on which a sheet to be fed to a printing portion in the apparatus is placed, and with an access door for replacing an ink tank.

Although a case in which a sheet to be printed is a paper sheet is described in the specification, the sheet may be any printable sheet recording medium other than the paper sheet. In addition, when a description is given below by taking the paper sheet as an example, the feed sheet tray may be referred to as a paper feed tray and the discharge sheet tray may be referred to as a paper discharge tray.

2. Description of the Related Art

As an image forming apparatus such as a color printer, there is an image forming apparatus including, on a front side of the apparatus, a paper feed tray on which a sheet to be printed is placed, and including, near a paper discharge port, a paper discharge tray on which a printed sheet is placed. In addition, there is widely known an image forming apparatus including, on an upper portion of the paper discharge tray, an openable and closable access door for mounting and dismounting a print head and an ink tank for performing printing.

For example, Japanese Patent Application Laid-Open No. 2005-119096 discloses a recording apparatus including a housing on which rotation hinges of a paper feed tray and a paper discharge tray are formed, and in a closed state, the paper discharge tray is accommodated in the housing and the paper feed tray functions as a cover for maintaining an internal portion of the apparatus in a shielded state. In particular, both the trays are accommodated on the same side of the housing, and hence a recording apparatus having a small occupation space is achieved. In this case, a sheet is fed from the paper feed tray located on one side of the housing to a printing portion in the apparatus, and a printed sheet is turned around and discharged to the paper discharge tray located on the same side of the housing as the paper feed tray.

However, in such a U-turn type paper feed and discharge system, if a discharged sheet comes into contact with a sheet on the paper feed tray, a paper feed resistance may be increased or fluctuated, thus causing an unfavorable paper feed such as a feed failure or a multi feed. Therefore, it is required to securely separate the sheet placed on the paper feed tray and the sheet to be placed on the paper discharge tray from each other.

Further, in order to perform operations of mounting and dismounting a print head and an ink tank as well as sheet control by access only in a direction on a front side of the apparatus, an openable and closable access cover is required. However, separate opening and closing operations of the three components including the paper feed tray, the paper discharge tray, and the access cover become troublesome, and if an order of the operations is set, this may increase a risk of an erroneous operation by a user.

Moreover, in order for the individual components to perform the opening and closing operations without interfering with one another, it is necessary to secure enough space between the components, possibly causing an increase of the apparatus in size and an increase of the manufacturing cost.

SUMMARY OF THE INVENTION

It is an object of the present invention to solve the above-mentioned problems. For example, the present invention is configured to achieve, in a configuration of three components including a paper feed tray, a paper discharge tray, and an access cover, suppression of dimension in a height direction of an apparatus, enhancement of reliability in paper feeding, and enhancement of opening and closing operability of the three components.

According to an exemplary embodiment of the present invention, there is provided an image forming apparatus, including: an image forming portion configured to form an image on a sheet; a housing which houses the image forming portion therein, the housing including an opening; an access cover provided so as to be rotatable with respect to the housing, and configured to cover at least a part of the opening when the access cover is closed; a feed tray provided so as to be rotatable with respect to the housing, and configured so that the sheet is placed thereon before the image is formed by the image forming portion; and a discharge tray provided so as to be rotatable with respect to the access cover, and configured so that the sheet is placed thereon after the image is formed by the image forming portion. A rotation pivot of the feed tray and a rotation pivot of the access cover are arranged on the same axis; and a rotation pivot of the discharge tray is arranged with a shift from the rotation pivot of the access cover.

Further features of the present invention will become apparent from the following description of exemplary embodiments with reference to the attached drawings.

DESCRIPTION OF THE EMBODIMENTS

Exemplary embodiments of the present invention are described below with reference to the accompanying drawings.

Figure 1:
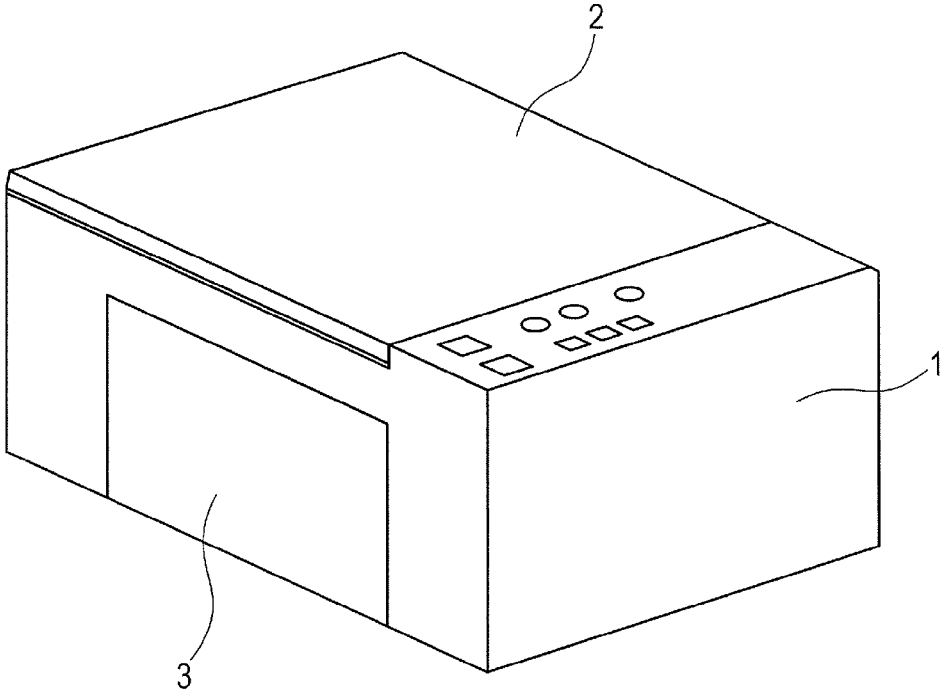
FIG. 1 is a perspective view of an image forming apparatus, for illustrating an accommodated state according to an embodiment of the present invention.
Figure 2:
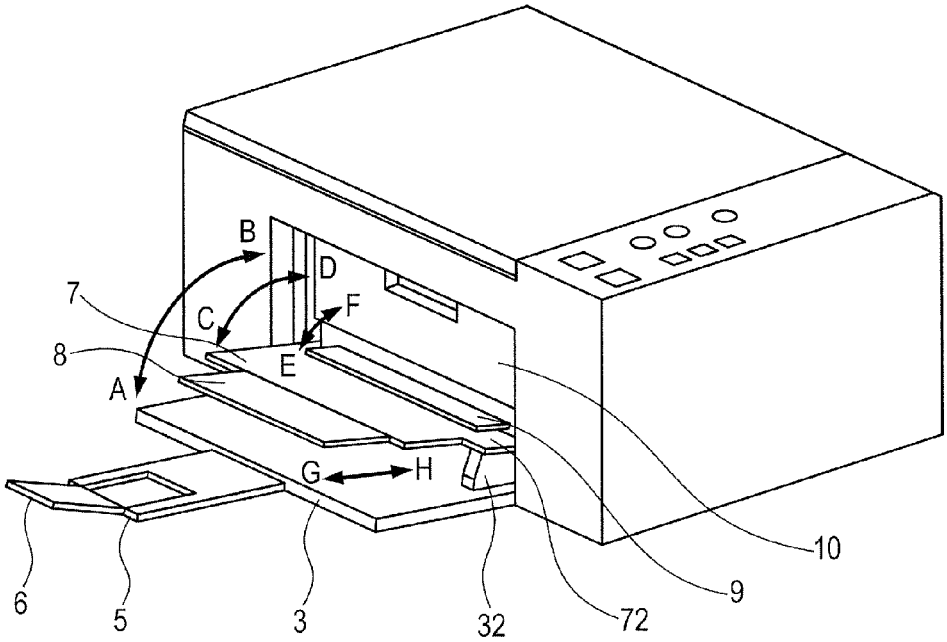
FIG. 2 is a perspective view of the image forming apparatus, for illustrating an image forming state according to the embodiment of the present invention.
Figure 3:
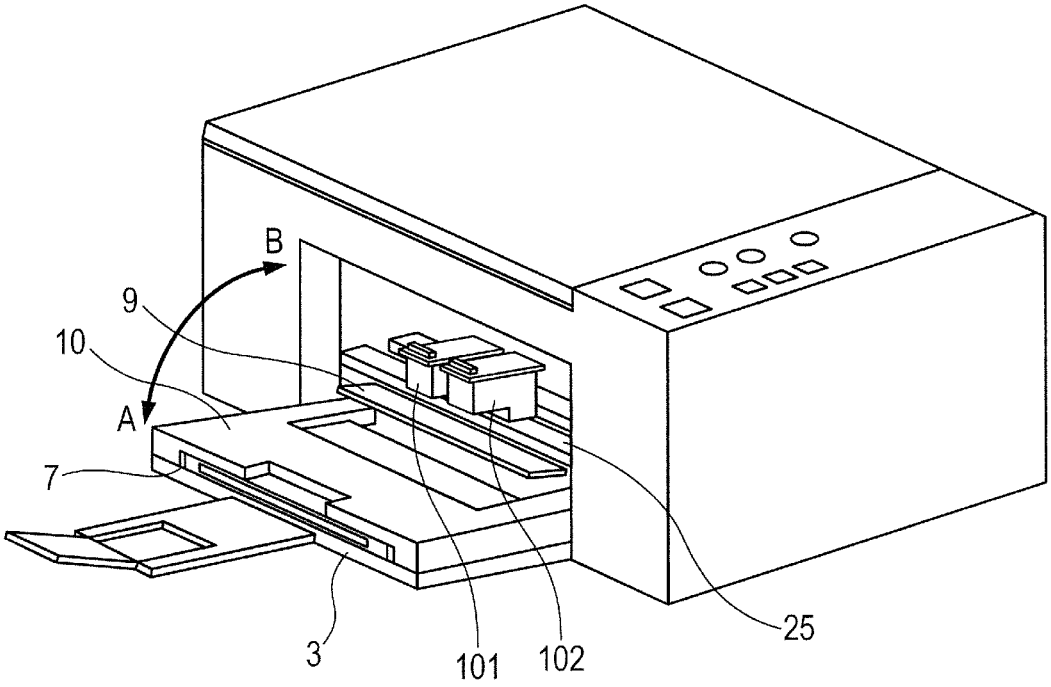
FIG. 3 is a perspective view of the image forming apparatus, for illustrating a maintenance state according to the embodiment of the present invention.
Figure 4:
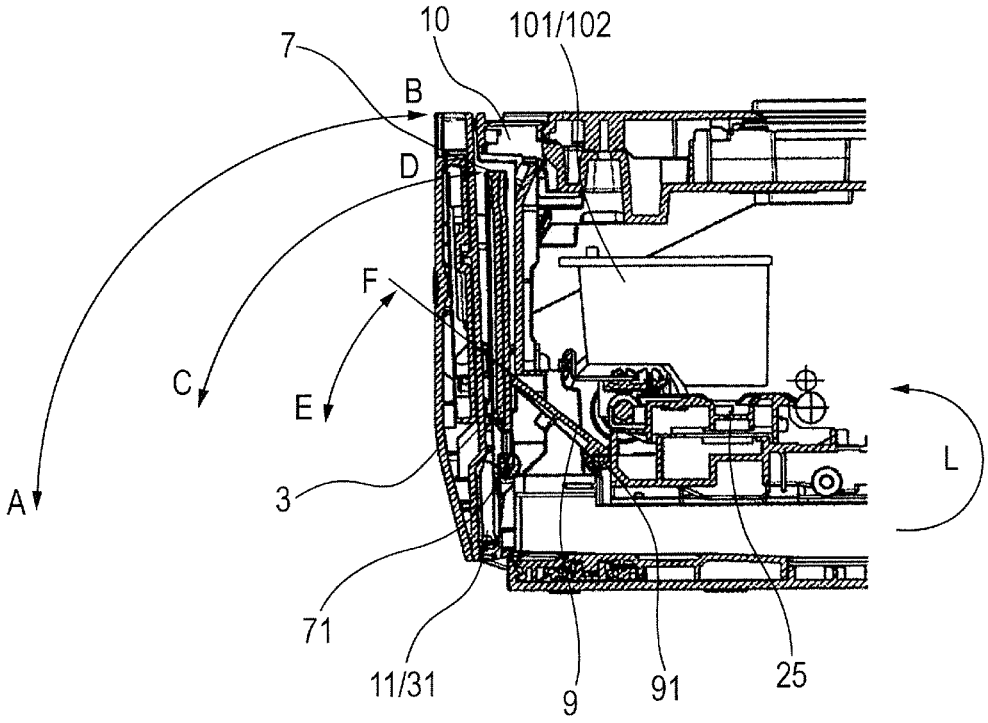
FIG. 4 is a cross-sectional view of the image forming apparatus, for illustrating the accommodated state according to the embodiment of the present invention.
Figure 5:
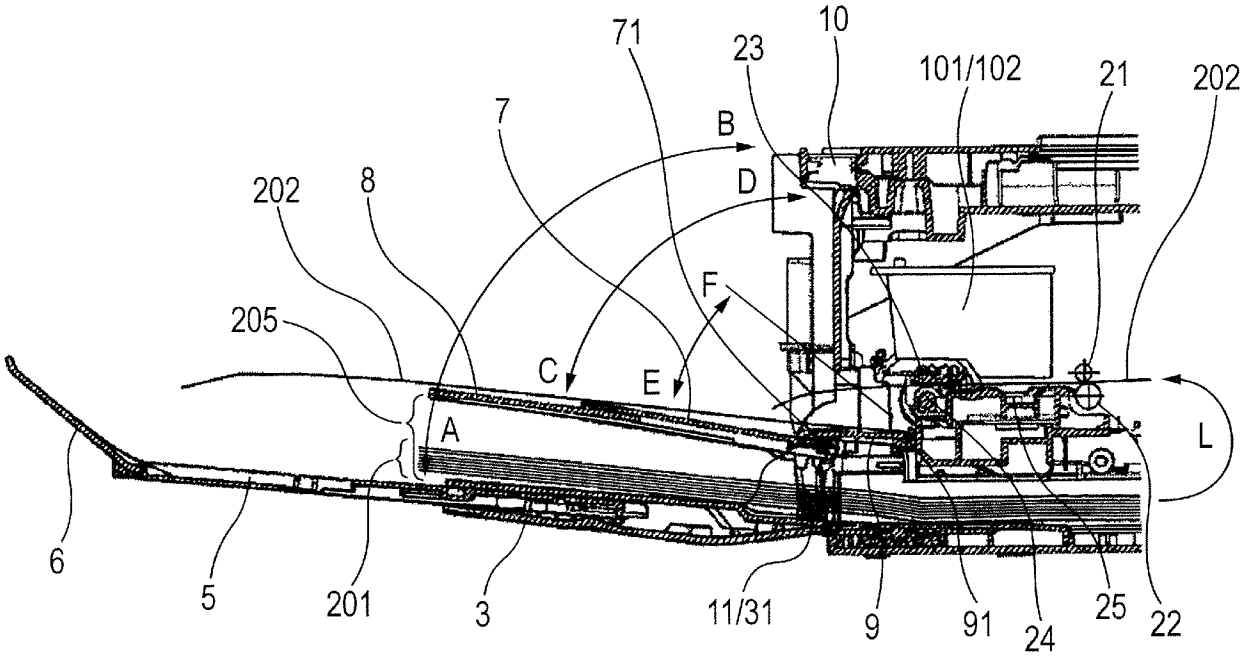
FIG. 5 is a cross-sectional view of the image forming apparatus, for illustrating the image forming state according to the embodiment of the present invention.
Figure 6:
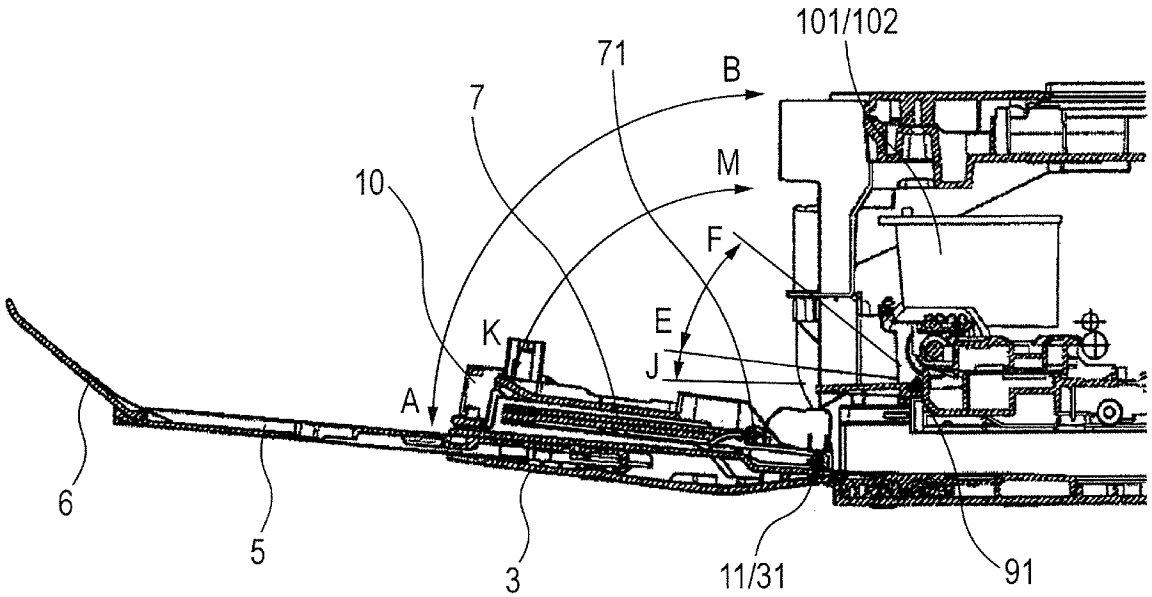
FIG. 6 is a cross-sectional view of the image forming apparatus, for illustrating the maintenance state according to the embodiment of the present invention.

FIG. 1 is a perspective view of an image forming apparatus, for illustrating an accommodated state according to an embodiment of the present invention, and FIG. 4 is a cross-sectional view for illustrating the accommodated state. FIG. 2 is a perspective view of the image forming apparatus, for illustrating an image forming state according to the embodiment of the present invention, and FIG. 5 is a cross-sectional view for illustrating the image forming state. FIG. 3 is a perspective view of the image forming apparatus, for illustrating a maintenance state according to the embodiment of the present invention, and FIG. 6 is a cross-sectional view for illustrating the maintenance state.

FIGS. 1 and 4 illustrate an image forming apparatus including an image reading apparatus in which an original cover 2 that is opened and closed when placing an original and a paper feed tray 3 (feed sheet tray) that is opened when forming an image (printing) are provided on a housing 1.

The paper feed tray 3 is configured to rotate in a direction of an arrow A illustrated in FIG. 4 about a paper feed tray rotation pivot 31 in the housing 1. Further, in order to perform operations of mounting and dismounting a print head for recording (printing) an image on a sheet (a paper sheet in the specification) and an ink tank for containing a print liquid such as ink to be supplied to the print head, an openable and closable access cover 10 is provided in a rotatable manner in the direction of the arrow A illustrated in FIG. 4 about an access cover rotation pivot 11 in the housing 1. The paper feed tray rotation pivot 31 and the access cover rotation pivot 11 are arranged on the same axis.

The access cover 10 is rotatably supported on one side of the housing 1 in such a manner that the access cover 10 closes an opening of the housing 1, which enables access to an image forming portion (the print head and the ink tank) built in the housing 1 from the outside, and opens the opening when accessing the image forming portion.

A paper discharge tray 7 (discharge sheet tray) on which a printed sheet is placed is provided in a rotatable manner in a direction of an arrow C illustrated in FIG. 4 about a paper discharge tray rotation pivot 71 on the access cover 10. The paper discharge tray rotation pivot 71 is arranged with a shift from the paper feed tray rotation pivot 31 and the access cover rotation pivot 11 that are arranged on the same axis.

A paper discharge sub tray 9 (discharge sheet sub tray) is provided in a rotatable manner in a direction of an arrow E or a direction of an arrow F illustrated in FIG. about a paper discharge sub tray rotation pivot 91 arranged on a platen 25 that supports a print paper sheet in an area in which an image is formed by using an ink cartridge 101/102.

FIGS. 2 and 5 illustrate a state in which the components are opened. A paper feed extension tray 5 (feed sheet extension tray) for extending a size of the paper feed tray 3 in a paper feed direction and a stopper 6 for preventing a drop of a leading edge of the printed sheet when being discharged are extended from an end of the paper feed tray 3 in a usage state. In addition, a paper discharge extension tray 8 (discharge sheet extension tray) is extended in a direction of an arrow G illustrated in FIG. from the paper discharge tray 7. The paper discharge extension tray 8 is latched to an end of the paper discharge tray 7 to extend a length of the paper discharge tray 7 in a paper discharge direction (a length in a sheet discharge direction). A paper discharge tray support portion 72 is formed in a part of the paper discharge tray in a width direction (a direction perpendicular to the paper discharge direction in the paper discharge tray 7). The paper discharge tray support portion 72 restricts a rotation of the paper discharge tray 7 by abutting on a paper feed tray reference surface 32 formed into a projecting shape on the paper feed tray 3.

In addition, the paper discharge sub tray 9 rotates in a direction of an arrow E illustrated in FIG. 5 for preventing a leading edge of a sheet from entering into a gap that can be formed between the paper discharge tray rotation pivot 71 and a paper discharge roller 24. The paper discharge sub tray 9 can cover and bridge over the gap when its leading edge abuts on the paper discharge tray 7. Therefore, a length of the paper discharge sub tray 9 in the paper discharge direction is larger than a distance between the paper discharge tray rotation pivot 71 and the paper discharge sub tray rotation pivot 91.

An operation of paper conveyance (sheet conveyance) at the time of printing is described with reference to FIG. 5. Multiple paper sheets 201 are first stacked on the paper feed tray 3, and the paper sheets 201 are fed one by one from the top by a pickup unit (not shown). Further, along a U-turn path formed in a direction of an arrow L illustrated in FIG. 5, the paper sheet is conveyed to a position of a paper sheet 202 in printing by a pair of a conveying roller 22 and a pinch roller 21, and by a pair of a spur roller 23 and the paper discharge roller 24. Thus, the paper sheet is discharged to the paper discharge tray 7.

In the image forming area on the platen 25, printing is performed on the paper sheet 202 by using the ink cartridge 101/102. When being discharged, a leading edge of the paper sheet 202 may be weighed down after passing the paper discharge roller 24, but the paper sheet 202 is supported by the paper discharge sub tray 9, and then discharged to the paper discharge tray 7 and the paper discharge extension tray 8. At this time, the farthest end position of the paper discharge extension tray 8 is substantially the same as a position of an end of the paper sheet 201 on the paper feed tray 3 (a trailing edge with respect to the paper feed direction) or extended further beyond the trailing edge of the paper sheet 201 in the paper discharge direction.

The image forming apparatus of the present application is configured as described above, and hence the paper sheet 202 being discharged does not affect the paper sheet 201 before being fed, which enables securing a minimum height 205 required to meet the paper feed capacity. In particular, the paper feed tray reference surface 32 on the paper feed tray 3 directly abuts on the paper discharge tray support portion 72 as illustrated in FIG. 2, and hence a positional accuracy of the paper discharge tray 7 in a usage state in a height direction of the apparatus can be enhanced. In addition, the length of the paper discharge sub tray 9 in the paper discharge direction is larger than the gap between the paper discharge tray rotation pivot 71 and the paper discharge sub tray rotation pivot 91, and hence the leading edge of the paper sheet 202 discharged by the paper discharge roller 24 can be transferred onto the paper discharge tray 7 without failure.

FIGS. 3 and 6 illustrate a state in which the access cover 10, which is used when mounting and dismounting the print head and the ink tank, is opened. In this state, an image forming portion (i.e., a portion in the apparatus in which the platen 25 and the ink cartridge 101/102 are arranged), which is covered so far, can be accessed from the outside. For example, an operation of replacing the ink cartridge 101/102 can be performed. At this time, since the paper discharge tray rotation pivot 71 of the paper discharge tray 7 is formed on the access cover 10, the paper discharge tray rotation pivot 71 rotates in a direction of an arrow A illustrated in FIG. 6 and the paper discharge tray 7 itself rotates in a direction of an arrow K illustrated in FIG. 6, in association with a rotation operation of the access cover 10. At this time, a length of the paper discharge tray support portion 72 illustrated in FIG. 2, which overlaps with the paper feed tray reference surface 32 in a direction of an arrow G/H, is set to be smaller than a gap between the access cover rotation pivot 11 and the paper discharge tray rotation pivot 71 (see FIG. 5), and hence an overlapped portion is gradually decreased in association with the rotation operation of the access cover 10 in the direction of the arrow A, thus achieving the opened state of the access cover 10, the paper feed tray 3, and the paper discharge tray 7 as illustrated in FIG. 3 without interfering with the rotation operation of the paper discharge tray 7 itself about the paper discharge tray rotation pivot 71. At this time, the paper discharge sub tray 9 rotates in a direction of an arrow E illustrated in FIG. 6 and stops rotating at a position indicated by an arrow J illustrated in FIG. 6 when abutting on the housing 1.

With the above-mentioned configuration, the opening and closing operation of the access cover 10 can be performed independently from operations of the other trays (such as the paper feed tray 3 and the paper discharge tray 7). In addition, the paper feed tray rotation pivot 31 and the access cover rotation pivot 11 are arranged on the same axis. Therefore, if the paper feed tray 3 rotates in a direction of an arrow B illustrated in FIG. 6, the paper discharge tray 7 can rotate in synchronization with the rotation of the paper feed tray 3 without interfering with each other. Accordingly, the access cover 10, the paper feed tray 3, and the paper discharge tray 7 can be put in the closed state as illustrated in FIG. 1 through a single unified operation. In the specification, the state as represented by the phrase "on the same axis" is not limited to a perfect matching of the rotation pivots, but includes a state in which there is a slight shift between the rotation pivots to an extent that can be deemed as being substantially the same axis.

In this embodiment, a so-called "multifunction peripheral (MFP)" including an image reading apparatus (scanner) is described as an example of the image forming apparatus, but the same effect of the present invention can be achieved even for an image forming apparatus having a single function of forming an image.

Further, in this embodiment, the paper discharge sub tray rotation pivot 91 is arranged on the platen 25, but the same effect of the present invention can be achieved even for a configuration in which the paper discharge sub tray rotation pivot 91 is arranged on the housing 1.

In addition, as for the paper discharge extension tray 8 and the paper feed extension tray 5, the same effect of the present invention can be achieved even if there is a variation in the number of parts and/or the extension method.

According to the present invention based on the above-mentioned embodiment, the paper sheet 202 discharged after printing does not come into contact with the paper sheet 201 on the paper feed tray 3, and hence the resistance acting on the paper feed can be maintained constant, thus enhancing the reliability of the paper feed.

In addition, a mounting space of the paper sheet 201 on the paper feed tray 3 can be maintained to the minimum through direct abutment between the paper feed tray 3 in the opened state and the paper discharge tray 7 in the opened state with respect to the apparatus housing, and hence the apparatus can be downsized by suppressing the dimension of the entire apparatus in the height direction. Moreover, when performing an operation of closing the paper feed tray 3 with respect to the apparatus housing, the paper discharge tray 7 and the access cover 10 can be closed simultaneously, and therefore, a user can perform an operation in a plain and easy manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179611, filed Aug. 19, 2011, which is hereby incorporated by reference herein in its entirety.

What is claimed is:

1. An image forming apparatus, comprising:

a housing which houses therein an image forming unit configured to form an image on a sheet, the housing including an opening which enables access to the image forming unit from the outside;

an access cover rotatably supported with a part of the housing, the access cover being openable with respect to the opening;

a first sheet tray rotatably supported with a part of the housing, on which a sheet is placed; and a second sheet tray rotatably supported with the access cover, on which a sheet is placed, wherein the first sheet tray and the second sheet tray are arranged so that the second sheet tray locates above the first sheet tray when the first sheet tray and the second sheet tray are opened, and wherein the access cover is openable independently of the first sheet tray, in a state in which the first sheet tray is opened, and a rotation pivot of the second sheet tray is moved according to the opening of the access cover.

2. An image forming apparatus according to claim 1, wherein when an image is formed on the sheet by the image forming unit, each of the first sheet tray and the second sheet tray is in an open state and the access cover is in a closed state, and when the image forming unit is maintained, the access cover is opened in a state in which each of the first sheet tray and the second sheet tray is in an open state.

3. An image forming apparatus according to claim 2, wherein the image forming unit includes an ink cartridge, and when the image forming unit is maintained, the access cover is opened and then replacement of the ink cartridge is executed.

4. An image forming apparatus according to claim 1, wherein on the first sheet tray a sheet to be supplied to the image forming unit is placed, and on the second sheet tray the sheet discharged from the image forming unit is placed.

5. An image forming apparatus according to claim 1, wherein a rotation pivot of the first sheet tray and a rotation pivot of the access cover are arranged on the same axis, and the rotation pivot of the second sheet tray is arranged with a shift from the rotation pivot of the access cover, and the rotation pivot of the second sheet tray moves downward according to the opening of the access cover.

6. An image forming apparatus according to claim 1, wherein in a state in which each of the first sheet tray and the second sheet tray is opened, a part of the second sheet tray abuts on a part of the first sheet tray to thereby restrict a positional relationship between the first sheet tray and the second sheet tray.

7. An image forming apparatus according to claim 1, wherein when the first sheet tray is closed from a state in which all of the first sheet tray, the second sheet tray and the access cover are opened, the second sheet tray and the access cover are closed together.

8. An image forming apparatus according to claim 1, further comprising a platen configured to support a sheet when an image is formed on the sheet with the image forming unit, and a rotatable sub-tray configured to support a sheet conveyed between the platen and the second sheet tray, wherein the sub-tray is opened as the second sheet tray is opened.

9. An image forming apparatus according to claim 1, wherein the second sheet tray includes an extension tray for extending a size of the second sheet tray, the extension tray being configured to be extendible.

* * * * *